US011031726B2

(12) United States Patent
Kim

(10) Patent No.: US 11,031,726 B2
(45) Date of Patent: Jun. 8, 2021

(54) CONNECTOR ASSEMBLY HAVING INFLOW RESISTANT INTERFACE

(71) Applicant: Tyco Electronics AMP Korea Co., Ltd., Gyungsan-si (KR)

(72) Inventor: Sung Chui Kim, Gyungsan-si (KR)

(73) Assignee: Tyco Electronics AMP Korea Co., Ltd., Gyungsan-Si (KR)

( * ) Notice: Subject to any disclaimer, the term of this patent is extended or adjusted under 35 U.S.C. 154(b) by 0 days.

(21) Appl. No.: 16/671,280

(22) Filed: Nov. 1, 2019

(65) Prior Publication Data

US 2020/0144762 A1 May 7, 2020

(30) Foreign Application Priority Data

Nov. 2, 2018 (KR) ..... 10-2018-0133454
Oct. 2, 2019 (KR) ..... 10-2019-0122086

(51) Int. Cl.

| | |
|---|---|
| ***H01R 13/52*** | (2006.01) |
| ***H01R 13/436*** | (2006.01) |
| ***H01R 13/506*** | (2006.01) |
| ***H01R 13/627*** | (2006.01) |
| *H01R 24/28* | (2011.01) |
| *H01R 105/00* | (2006.01) |
| *H01R 24/20* | (2011.01) |

(52) U.S. Cl.

CPC ..... *H01R 13/5202* (2013.01); *H01R 13/4367* (2013.01); *H01R 13/506* (2013.01); *H01R 13/5208* (2013.01); *H01R 13/6272* (2013.01); *H01R 24/20* (2013.01); *H01R 24/28* (2013.01); *H01R 2105/00* (2013.01)

(58) Field of Classification Search

CPC ..... H01R 13/5202; H01R 13/5804; H01R 13/506; H01R 13/5208; H01R 13/4367; H01R 13/6272; H01R 24/20; H01R 24/28; H01R 2105/00

USPC ..... 439/352, 351, 355, 470

See application file for complete search history.

(56) References Cited

U.S. PATENT DOCUMENTS

| | | | | |
|---|---|---|---|---|
| 6,623,303 | B2 * | 9/2003 | Syed | H01R 13/6485 439/470 |
| 6,896,538 | B2 * | 5/2005 | Grubbs | H01R 13/52 439/352 |
| 6,913,494 | B2 * | 7/2005 | Ward | H01R 13/4365 439/352 |
| 7,563,125 | B2 * | 7/2009 | Pepe | H01R 4/242 439/417 |
| 7,727,002 | B2 * | 6/2010 | Bethurum | H01R 4/4818 439/441 |
| 7,753,718 | B2 * | 7/2010 | Bethurum | H01R 24/20 439/441 |

(Continued)

*Primary Examiner* — Abdullah A Riyami
*Assistant Examiner* — Marcus E Harcum
(74) *Attorney, Agent, or Firm* — Barley Snyder

(57) ABSTRACT

A connector assembly includes a cap housing with a first fastener, a plug, and a position assurance member coupled to the plug and the cap housing. The plug includes a first end portion to be inserted into the cap housing, a plug-side flange protruding from an outer side of the plug, and a second fastener to be fastened to the first fastener. A first end portion of the cap housing is inserted into the plug-side flange. The position assurance member has a coupling flange into which a second end portion of the plug and a second end portion of the cap housing are inserted.

20 Claims, 11 Drawing Sheets

(56) References Cited

U.S. PATENT DOCUMENTS 8,235,744 B1 * 8/2012 Liptak ..... H01R 13/633 439/352
8,317,545 B2 * 11/2012 Iida ..... H01R 13/7197 439/620.15
8,444,429 B2 * 5/2013 Ebihara ..... H01R 43/26 439/352
8,591,247 B2 * 11/2013 Zhu ..... H01R 13/6273 439/352
2004/0102082 A1 * 5/2004 Tsuji ..... H01R 13/562 439/470
2006/0094281 A1 * 5/2006 Dang ..... H01R 13/6275 439/352
2007/0059969 A1 * 3/2007 Shamoto ..... H01R 13/641 439/352
2008/0009171 A1 * 1/2008 Tsuji ..... H01R 13/6272 439/352
2008/0261437 A1 * 10/2008 Kobayashi ..... H01R 13/6272 439/352
2009/0035980 A1 * 2/2009 Nakamura ..... H01R 13/641 439/352
2010/0136822 A1 * 6/2010 Van Stiphout ..... H01R 43/02 439/470
2011/0237117 A1 * 9/2011 Lim ..... H01R 13/5812 439/470
2012/0094509 A1 * 4/2012 Bryan ..... B60Q 11/005 439/76.1
2012/0312346 A1 * 12/2012 Roman, Jr. ..... H01R 13/5808 136/244
2013/0130535 A1 * 5/2013 Plazio ..... H01R 13/502 439/350
2013/0137289 A1 * 5/2013 Youn ..... H01R 13/641 439/352
2013/0316574 A1 * 11/2013 Peuchet ..... H01R 13/5812 439/574
2018/0351292 A1 * 12/2018 Finona ..... H01R 13/622
2019/0027871 A1 * 1/2019 Data ..... H01R 13/15
2019/0221962 A1 * 7/2019 Kobayashi ..... H01R 13/56

* cited by examiner

CONNECTOR ASSEMBLY HAVING INFLOW RESISTANT INTERFACE

CROSS-REFERENCE TO RELATED APPLICATIONS

This application claims the benefit of the filing date under 35 U.S.C. § 119(a)-(d) of Korean Patent Application No. 10-2018-0133454, filed on Nov. 2, 2018, and Korean Patent Application No. 10-2019-0122086, filed on Oct. 2, 2019.

FIELD OF THE INVENTION

The present invention relates to a connector assembly and, more particularly, to a connector assembly including a housing and a plug inserted in the housing.

BACKGROUND

A connector assembly may be provided in a space filled with a foaming member for thermal insulation, as in, for example, a refrigerator. In general, a foaming member is hardened after being injected in the form of liquid. Thus, when the space is filled with the foaming member, the foaming member may flow into the connector assembly provided in the space.

Even when a sealing structure is adopted to prevent the inflow of the foaming member into the connector assembly, it is impossible to achieve sufficient sealing due to the characteristic of the foaming member and the filling pressure. For example, in a case of a water-resistant connector, a foaming member may flow thereinto through a gap between sealing members, for example, wire seal, peripheral seal, O-ring seal, grommet, and gasket. Further, in a case of a non-water-resistant connector, a foaming member may flow into a connector even when the connector is sealed with adhesive tapes, sponges, or glues.

SUMMARY

A connector assembly includes a cap housing with a first fastener, a plug, and a position assurance member coupled to the plug and the cap housing. The plug includes a first end portion to be inserted into the cap housing, a plug-side flange protruding from an outer side of the plug, and a second fastener to be fastened to the first fastener. A first end portion of the cap housing is inserted into the plug-side flange. The position assurance member has a coupling flange into which a second end portion of the plug and a second end portion of the cap housing are inserted.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
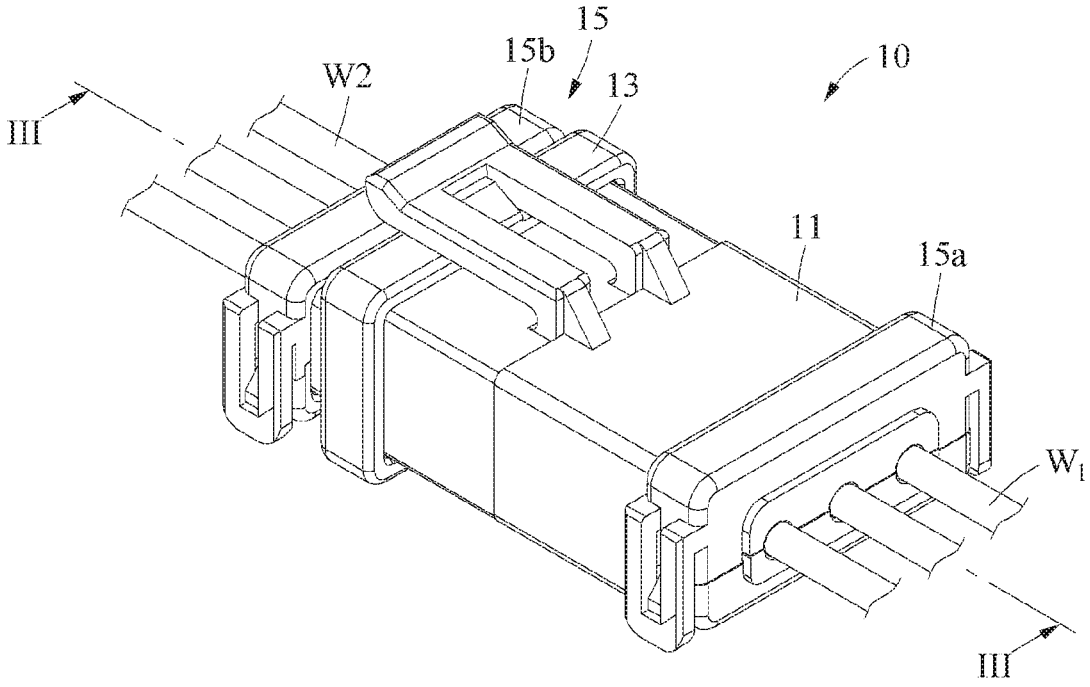
FIG. 1 is a perspective view of a connector assembly according to an embodiment.

Hereinafter, embodiments will be described in detail with reference to the illustrative drawings. In denoting reference numerals to constituent elements of the respective drawings, it should be noted that the same constituent elements will be designated by the same reference numerals, if possible, even though the constituent elements are illustrated in different drawings. Further, in the following description of the present embodiments, a detailed description of publicly known configurations or functions incorporated herein will be omitted when it is determined that the detailed description obscures the subject matters of the present embodiments.

In addition, the terms first, second, A, B, (a), and (b) may be used to describe constituent elements of the embodiments. These terms are used only for the purpose of discriminating one constituent element from another constituent element, and the nature, the sequences, or the orders of the constituent elements are not limited by the terms. When one constituent element is described as being "connected", "coupled", or "attached" to another constituent element, it should be understood that one constituent element can be connected or attached directly to another constituent element, and an intervening constituent element can also be "connected", "coupled", or "attached" to the constituent elements.

The constituent element, which has the same common function as the constituent element included in any one embodiment, will be described by using the same name in other embodiments. Unless disclosed to the contrary, the configuration disclosed in any one embodiment may be applied to other embodiments, and the specific description of the repeated configuration will be omitted.

Figure 2:
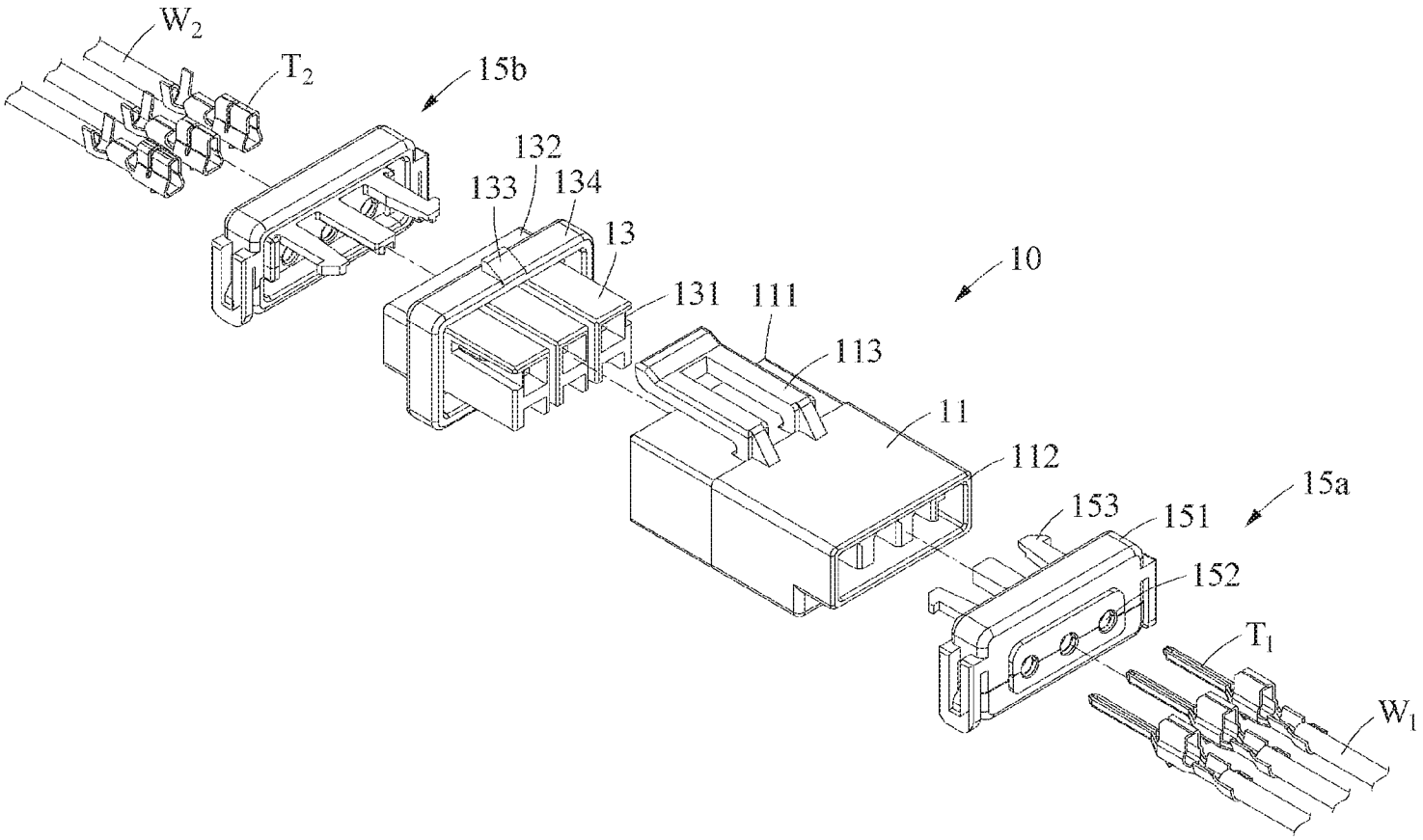
FIG. 2 is an exploded perspective view of the connector assembly.
Figure 3:
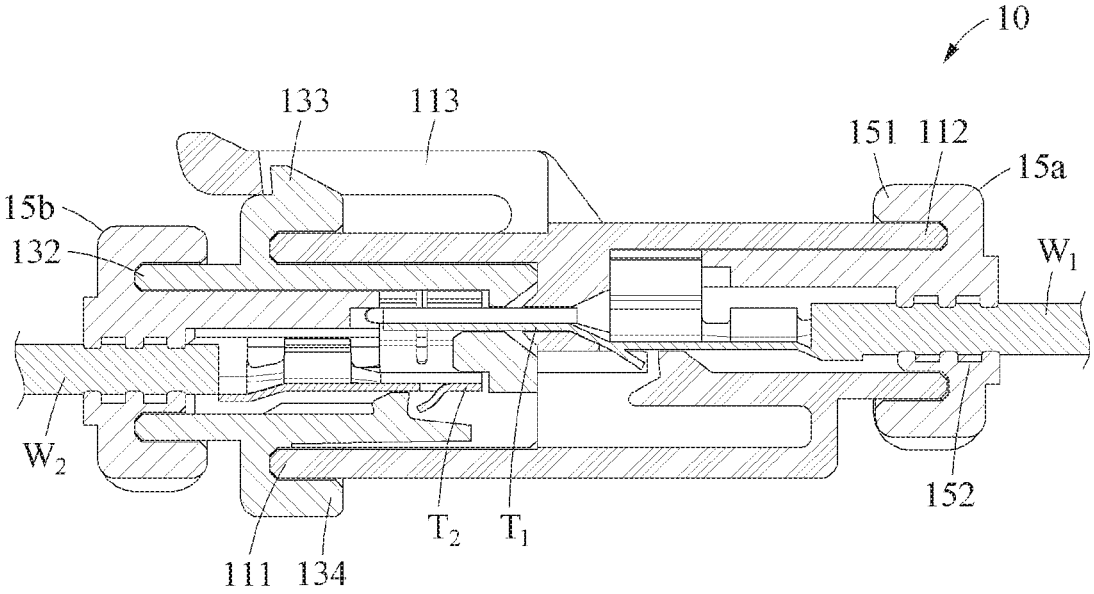
FIG. 3 is a sectional side view of the connector assembly, taken along line of FIG. 1.
Figure 4A:
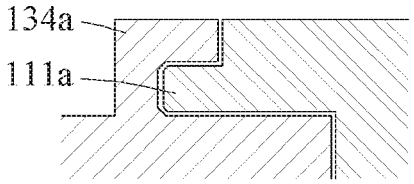
FIG. 4A is a sectional side view of a coupling portion of a plug and a cap housing according to an embodiment.
Figure 4B:
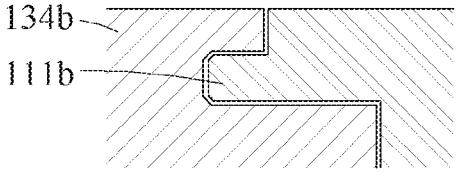
FIG. 4B is a sectional side view of a coupling portion of a plug and a cap housing according to another embodiment.
Figure 4C:
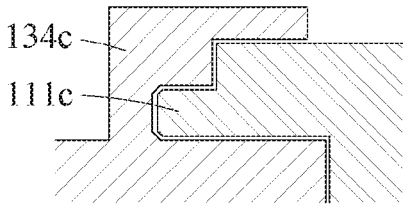
FIG. 4C is a sectional side view of a coupling portion of a plug and a cap housing according to another embodiment.
Figure 4D:
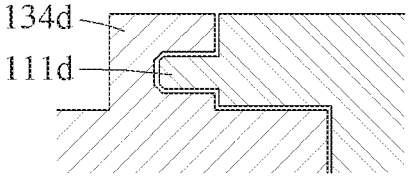
FIG. 4D is a sectional side view of a coupling portion of a plug and a cap housing according to another embodiment.
Figure 4E:
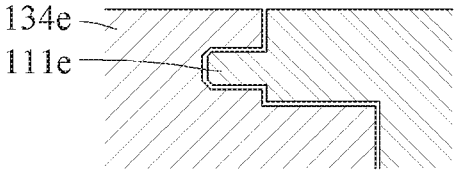
FIG. 4E is a sectional side view of a coupling portion of a plug and a cap housing according to another embodiment.
Figure 4F:
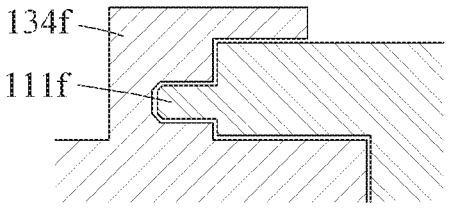
FIG. 4F is a sectional side view of a coupling portion of a plug and a cap housing according to another embodiment.
Figure 4G:
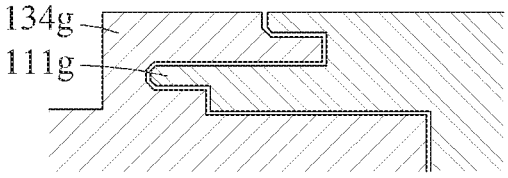
FIG. 4G is a sectional side view of a coupling portion of a plug and a cap housing according to another embodiment.
Figure 4H:
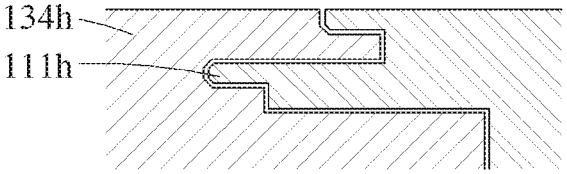
FIG. 4H is a sectional side view of a coupling portion of a plug and a cap housing according to another embodiment.
Figure 4I:
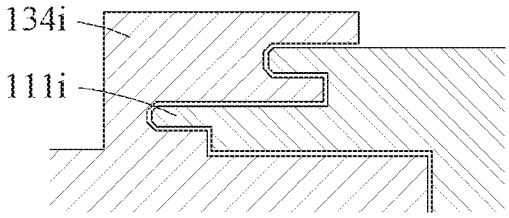
FIG. 4I is a sectional side view of a coupling portion of a plug and a cap housing according to another embodiment.
Figure 4J:
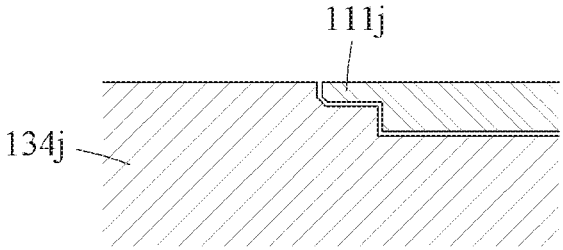
FIG. 4J is a sectional side view of a coupling portion of a plug and a cap housing according to another embodiment.

A connector assembly 10 according to an embodiment is shown in FIGS. 1-3. The connector assembly 10 comprises a cap housing 11, a plug 13, and a position assurance member 15 to be coupled to respective end portions of the cap housing 11 and the plug 13. The cap housing 11 and the plug 13 respectively include a plurality of terminals T1 and T2 provided therein, and wires W1 and W2 are respectively connected to the terminals T1 and T2.

As shown in FIGS. 2 and 3, a portion of the cap housing 11 coupled to the plug 13 is a first end portion 111, and an opposite portion of the cap housing 11 is a second end portion 112. A portion of the plug 13 coupled to the cap housing 11 is a first end portion 131, and an opposite portion of the plug 13 is a second end portion 132.

To maintain the coupling state of the cap housing 11 and the plug 13, as shown in FIGS. 2 and 3, a first fastener 113 is formed on the cap housing 11 and a second fastener 133 is formed on outer sides of the plug 13. In an embodiment, the second fastener 133 may have a shape of a locking bump protruding from at least one position on the outer side of the plug 13. The first fastener 113, in an embodiment, has a shape of an outer latch to be caught and coupled to the second fastener 133, and may be in the shape of a cantilever formed to extend toward a direction in which the first fastener 113 is coupled to the plug 13 in the cap housing 11. The shape of the second fastener 133 and the shape of the first fastener 113 may be different in other embodiments; the first fastener 113 and the second fastener 133 may have various shapes to be fastened to each other so as to maintain the coupling state thereof.

As shown in FIGS. 2 and 3, the second fastener 133 is formed on an outer side of a plug-side flange 134. By forming the second fastener 133 in this manner, a length of external exposure of the plug 13 may be reduced, and the length of the first fastener 113 may be reduced. Further, it may be easy to match the height of the first fastener 113 and the second fastener 133 in view of the thickness and the protruding height of the cap housing 11 when the first fastener 113 protrudes from the cap housing 11.

In the shown embodiment, the first fastener 113 and the second fastener 133 each are formed at one position. In other embodiments, the first fastener 113 and the second fastener 133 may be formed at a plurality of positions, including being formed at two positions, for example, on the top surface and the bottom surface.

Because the first end portion 131 is inserted into the cap housing 11, as shown in FIGS. 1-3, the first end portion 111 of the cap housing 11 may be positioned on the outer surface of the plug 13. At a position corresponding to the first end portion 111 of the cap housing 11 on the outer surface of the plug 13, the plug-side flange 134 is formed such that the first end portion 111 of the cap housing 11 may be inserted thereinto.

In the embodiment shown in FIGS. 1-3, the plug-side flange 134 is bent approximately in a "square U" shape toward the cap housing 11, such that the first end portion 111 of the cap housing 11 may be inserted thereinto. The plug-side flange 134 may be formed along the entire outer circumference of the plug 13. By bending the plug-side flange 134 and inserting the first end portion 11 of the cap housing 111 thereinto, an inflow of a foaming member into the connector assembly 10 may be prevented through a gap between the first end portion 11 of the cap housing 111 and the outer sides of the plug 13. Further, although a separate member is not provided, the inflow of the foaming member may be prevented using only a coupling structure of the cap housing 11 and the plug 13.

The foaming member is injected in the form of liquid, and thus the pressure at the time of filling may cause an inflow of the foaming member into the connector assembly 10, such as through the coupling portion of the cap housing 11 and the plug 13. In this embodiment, to prevent the inflow of the foaming member into the connector assembly 10, the coupling portion of the cap housing 11 and the plug 13 may be provided in various shapes.

A coupling portion of the cap housing 11 and the plug 13 according to various embodiments is shown in FIGS. 4A-4J. FIGS. 4A-4J illustrate only the plug-side flange 134 and the first end portion 111 of the cap housing 11; the reference numeral of the plug-side flange 134 and the reference numeral of the first end portion 111 of the cap housing 11 are each followed by a to j, respectively corresponding to FIGS. 4A-4J, to differentiate the various embodiments.

As shown in FIGS. 4A-4J, the plug-side flange 134 and the first end portion 111 of the cap housing 11 may form a plurality of stepped portions and be provided in the corresponding shapes so as to be coupled to each other. When a plurality of stepped portions are formed at each of the plug-side flange 134 and the first end portion 111 of the cap housing 11, routes along which the foaming member is to flow into the connector assembly 10 may become relatively complex and long. Thus, the inflow of the foaming member may be prevented more effectively. The shapes of the embodiments of FIGS. 4A-4J, however, are merely exemplary, and the shapes of the plug-side flange 134 and the first end portion 111 of the cap housing 11 are not limited thereto.

As shown in FIGS. 1-3, the position assurance member 15 is provided in each of the second end portion 112 of the cap housing 11 and the second end portion 132 of the plug 13. The position assurance member provided in the cap housing 11 is a first position assurance member 15*a* and the position assurance member provided in the plug 13 is a second position assurance member 15*b*. However, because the first and second position assurance members 15*a* and 15*b* are substantially the same, the first and second position assurance members 15*a* and 15*b* will be collectively referred to as the position assurance member 15 unless there is a need to describe the first and second position assurance members 15*a* and 15*b* separately.

The position assurance member 15, as shown in FIGS. 1-3, includes wire holes 152 through which the wires W1 and W2 may be inserted, a latch 153 protruding a predetermined length at a portion to be inserted into the plug 13 or the cap housing 11, and a coupling flange 151 into which each of the second end portion 112 of the cap housing 11 and the second end portion 132 of the plug 13 is to be inserted.

Figure 5:
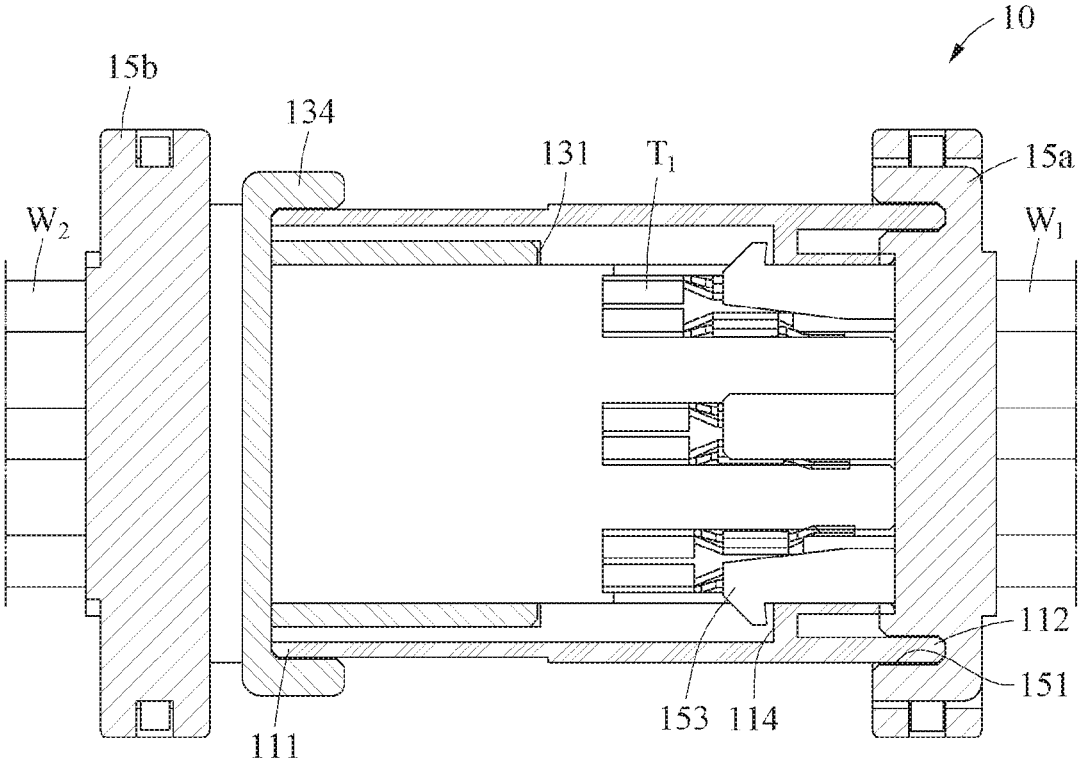
FIG. 5 is a sectional top view of a coupling portion of a position assurance member and a cap housing in the connector assembly.
Figure 6:
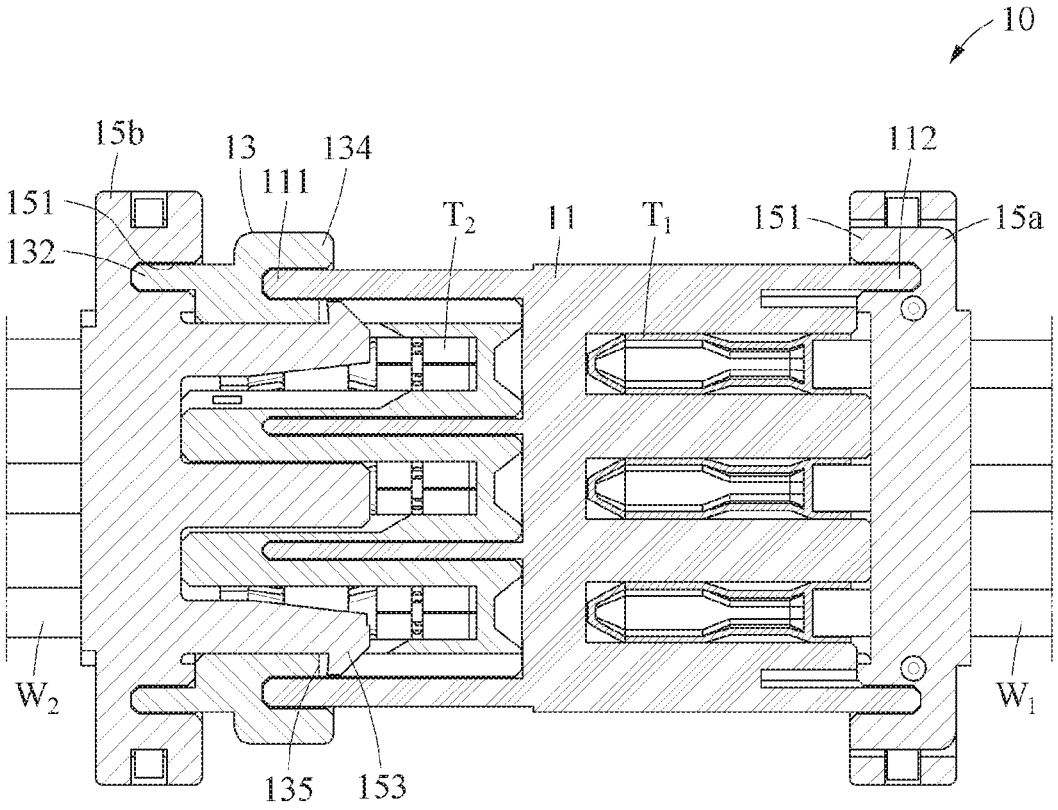
FIG. 6 is a sectional top view of the coupling portion of the position assurance member and a plug in the connector assembly.
Figure 7:
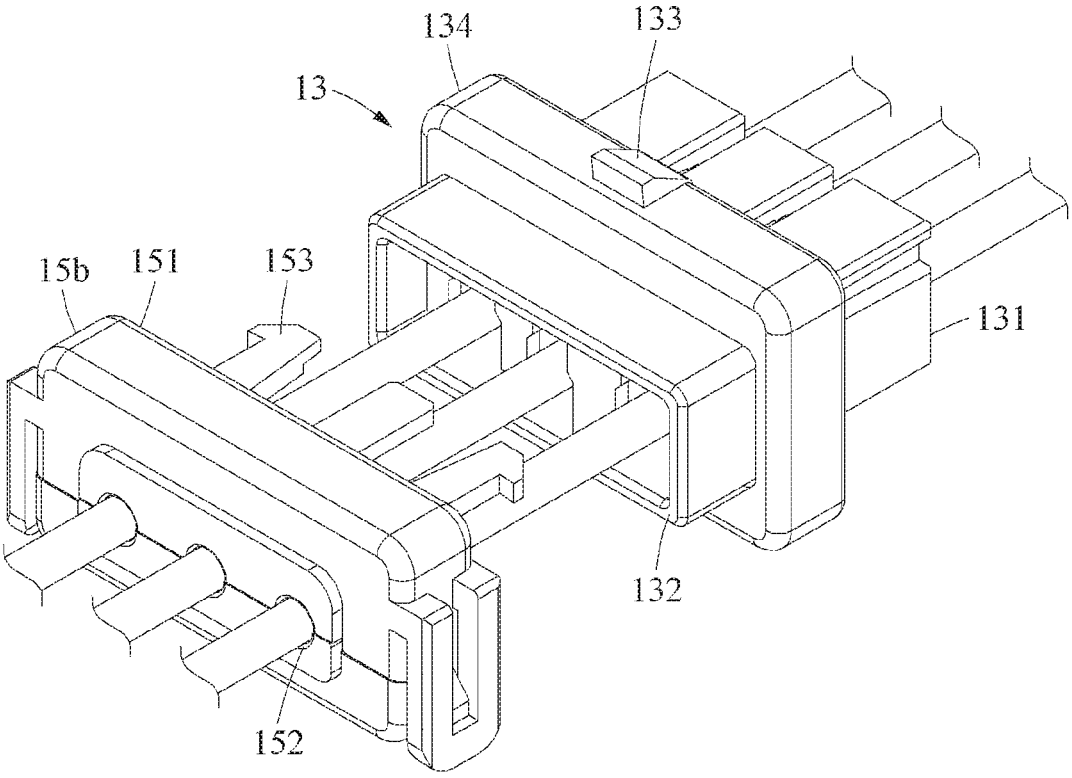
FIG. 7 is an exploded perspective view of the coupling portion of the position assurance member and the plug.

As shown in FIGS. 5-7, latch fastening grooves 114 and 135 may be formed respectively on inner sides of the cap housing 11 and the plug 13, such that the latch 153 of the position assurance member 15 may be caught and coupled thereto. When the position assurance member 15 is inserted into each of the second end portion 112 of the cap housing 11 and the second end portion 132 of the plug 13, the latch 153 may be caught and coupled to the latch fastening groove 114 or 135 in the connector assembly 10, whereby the position assurance member 15 may be coupled and the coupling state may be maintained.

As shown in FIGS. 2 and 3, the coupling flange 151 may be formed to prevent the inflow of the foaming member through the position assurance member 15 and the coupling portion of the plug 13 and the cap housing 11. The coupling flange 151 may be formed along the entire outer circumference of the position assurance member 15. Similar to the plug-side flange 134, the coupling flange 151 may also be bent approximately in the "square U" shape, such that each of the second end portion 112 of the cap housing 11 and the second end portion 132 of the plug 13 may be inserted thereinto. Further, similar to the plug-side flange 134, the coupling flange 151 may form a plurality of stepped portions, as shown in FIGS. 4A-4J.

The position assurance member 15, as shown in FIGS. 5-9, may be divided into a first division member 510 and a second division member 520, provided in a structure to engage with each other while the wires W1 and W2 are disposed therebetween. In an embodiment shown in FIG. 8, the position assurance member 15 includes an assurance connector 530 connecting the first division member 510 and the second division member 520.

Figure 8:
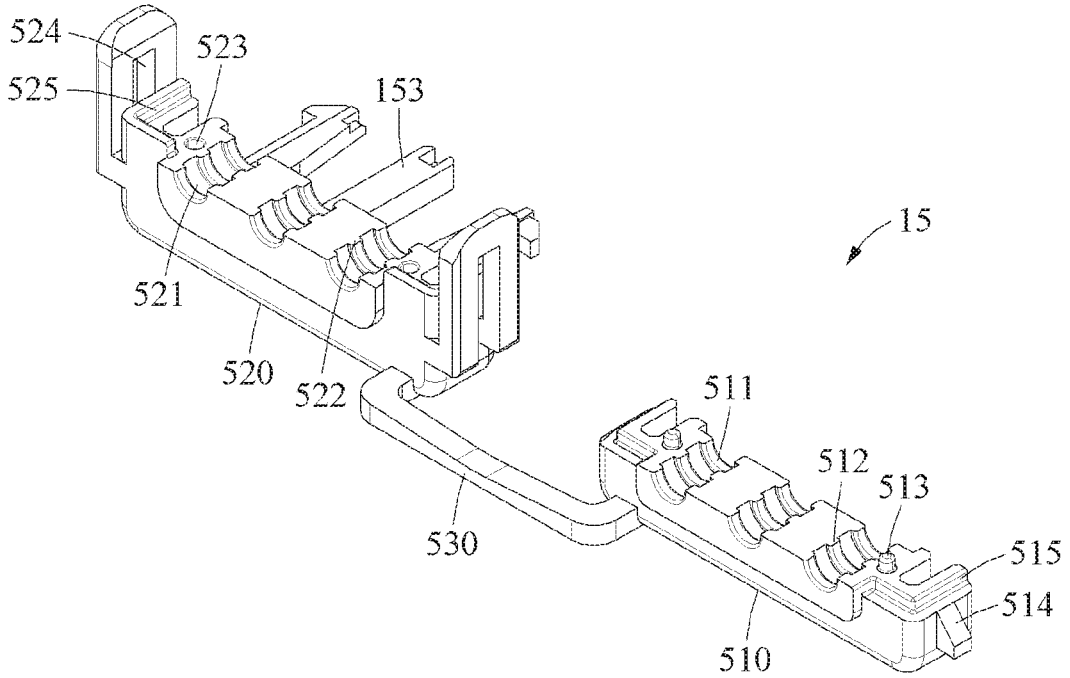
FIG. 8 is a perspective view of the position assurance member.
Figure 9:
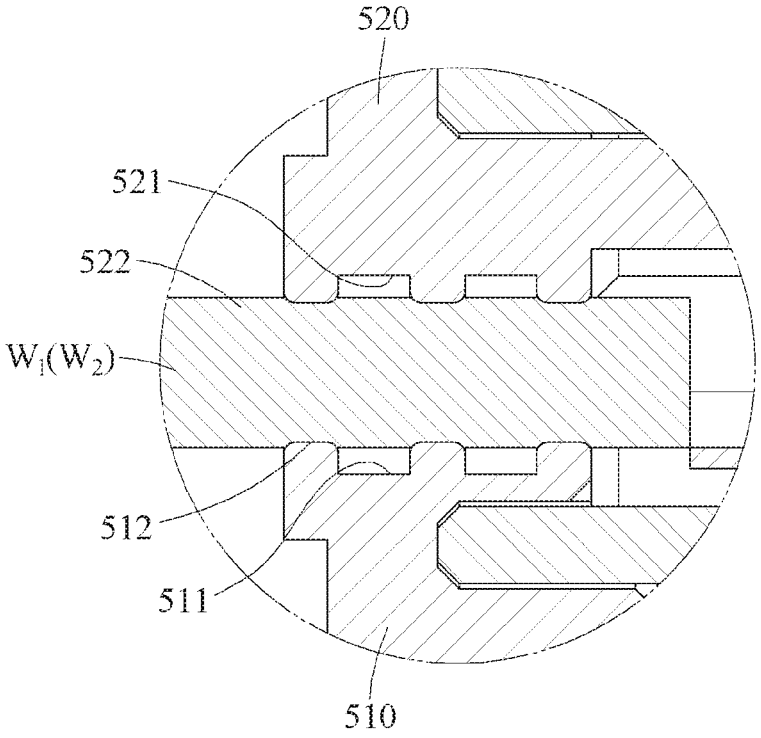
FIG. 9 is a sectional side view of a first division member and a second division member of the position assurance member mated with a wire.

The first division member 510 and the second division member 520, as shown in FIGS. 8 and 9, include semi-cylindrical wire grooves 511 and 521 formed to fit on an outer circumferential surface of the wires W1 and W2, a plurality of first locking portions 513, 523 on surfaces thereof to be coupled to each other, a plurality of second locking portions 514, 524 on the outer sides of the first division member 510 and the second division member 520, and a plurality of sealing stepped portions 515 and 525.

The wire grooves 511 and 521 form the wire holes 152 when the first division member 510 and the second division member 520 are coupled. The position assurance member 15, as shown in FIGS. 8 and 9, includes a plurality of uneven portions 512 and 522 on the inner circumferential surface of the wire grooves 511 and 521 to press the outer circumferential surface of the wires W1 and W2. The uneven portions 512 and 522 may be provided in the shape of a band with a predetermined width corresponding to the outer circumference of the wires W1 and W2. A plurality of uneven portions 512 and 522 may be formed along the longitudinal direction of the wires W1 and W2. In this example, when the first division member 510 and the second division member 520 are coupled to the wires W1 and W2, the uneven portions 512 and 522 may press the outer circumferential surface of the wires W1 and W2. Thus, the position assurance member 15 may prevent an inflow of a foaming member through gaps between the wire holes 152 and the outer circumferential surface of the wires W1 and W2.

The position assurance member 15 may include the latch 153 on one of the first division member 510 and the second division member 520, as shown in FIG. 8. In the shown embodiment, the latch 153 is formed on the second division member 520. In another embodiment, the latch 153 may be formed on the first division member 510. The latch 153 is formed on only one of the first division member 510 and the second division member 520; the structure of the position assurance member 15 may be simplified, and the position assurance member 15 may be fixed to the cap housing 11 and the plug 13.

The second division member 520 in the position assurance member 15 may be fixed to the cap housing 11 and the plug 13 by the latch 153. By forming the first locking portions 513 and 523 and the second locking portions 514 and 524, a separation of the first division member 510 and the second division member 520 from each other may be prevented.

The first locking portions 513 and 523, as shown in FIG. 8, include a plurality of projections 513 formed to protrude from the surface of the first division member 510 coupled to the second division member 520, and a plurality of grooves 523 formed on the second division member 520, such that the projections 513 may be inserted thereinto. However, the positions and the shapes of the projections 513 and the grooves 523 in the first locking portions 513 and 523 are not limited thereto. In another example, the first locking portions 513 and 523 may include grooves formed on the first division member 510 and projections formed on the second division member 520. In a state in which the position assurance member 15 is coupled to the cap housing 11 and the plug 13, the projections 513 may be coupled to the grooves 523, thereby maintaining the fixing state of the first division member 510 and the second division member 520 and preventing a separation thereof from each other.

As shown in FIG. 8, the second locking portions 514 and 524 may include protrusions 514 formed outward from the first division member 510, and protruding pieces 524 formed on the second division member 520, so as to be locked with the protrusions 514. However, the positions and the shapes of the protrusions 514 and the protruding pieces 524 in the second locking portions 514 and 524 are not limited thereto. In another example, the second locking portions 514 and 524 may include protruding pieces formed on the first division member 510 and protrusions formed on the second division member 520. In a state in which the position assurance member 15 is coupled to the cap housing 11 and the plug 13, the protruding pieces 524 may be locked with the protrusions 514, thereby maintaining the fixing state of the first division member 510 and the second division member 520 and preventing a separation thereof from each other.

The sealing stepped portions 515 and 525, shown in FIG. 8, may prevent an inflow of a foaming member through the coupling portion of the first division member 510 and the second division member 520. For example, a first sealing stepped portion 515 having a predetermined stepped shape may be formed along an edge of the first division member 510, and a second sealing stepped portion 525 may be formed to protrude to a predetermined height along an edge of the second division member 520, so as to cover the outer side of the first sealing stepped portion 515. However, the positions and the shapes of the sealing stepped portions 515 and 525 in the first division member 510 and the second division member 520 are not limited thereto. In another example, the sealing stepped portions 515 and 525 may include a sealing stepped portion formed to protrude from the first division member 510, and a sealing stepped portion having a predetermined shape not protruding from the edge of the second division member 520. By forming the sealing stepped portions 515 and 525 on the first division member 510 and the second division member 520 such that the edges of the first division member 510 and the second division member 520 may overlap, an inflow of a foaming member into the position assurance member 15 and the connector assembly 10 through the coupling portion and the edges of the first division member 510 and the second division member 520 may be effectively prevented.

By forming the plug-side flange 134 on the coupling portion of the cap housing 11 and the plug 13 and forming the coupling flange 151 on the coupling portion of the position assurance member 15 and the cap housing 11 and the coupling portion of the position assurance member 15 and the plug 13, an inflow of the foaming member into the connector assembly 10 through the coupling portions of the components may be prevented. Further, an inflow of the foaming member into the connector assembly 10 may be prevented using only the coupling structure of the components, without using a separate member.

What is claimed is:

1. A connector assembly, comprising:

a cap housing having a first fastener and a first end portion formed thereon;

a plug including:

a first end portion to be inserted into the cap housing, a plug-side flange including a plurality of first stepped portions, the plug-side flange protruding from an outer side of the plug, the first end portion of the cap housing is inserted into the plug-side flange, the first end portion including a plurality of second stepped portions corresponding to a shape of the first stepped portions, and a second fastener formed on the plug and configured to be fastened to the first fastener; and a position assurance member coupled to the plug and the cap housing, the position assurance member having a coupling flange into which a second end portion of the plug and a second end portion of the cap housing are inserted, wherein the plug-side flange is bent toward a direction in which the plug-side flange is coupled to the cap housing, and wherein the plug-side flange is formed on an entire outer circumference of the plug.

2. The connector assembly of claim 1, wherein the second fastener protrudes from the plug-side flange.

3. The connector assembly of claim 1, wherein the second fastener is formed on the outer side of the plug.

4. The connector assembly of claim 1, wherein the first fastener is a cantilever extending in a direction in which the first fastener is coupled to the plug.

5. The connector assembly of claim 1, wherein the coupling flange is formed on an entire outer circumference of the position assurance member.

6. The connector assembly of claim 1, wherein the position assurance member includes a latch formed at a first end portion of the position assurance member, the latch inserted into the plug or the cap housing.

7. The connector assembly of claim 6, wherein the plug has a latch fastening groove on an inner wall of the plug, the latch of the position assurance member is caught in the latch fastening groove of the plug.

8. The connector assembly of claim 6, wherein the cap housing has a latch fastening groove on an inner wall of the cap housing, the latch of the position assurance member is caught in the latch fastening groove of the cap housing.

9. The connector assembly of claim 1, wherein the position assurance member has a first division member and a second division member, a wire is disposed between the first division member and the second division member.

10. The connector assembly of claim 9, wherein the first division member and the second division member each have a plurality of semi-cylindrical wire grooves formed to fit on an outer circumferential surface of the wire.

11. The connector assembly of claim 10, wherein a plurality of uneven portions are formed on an inner circumferential surface of the wire grooves to press the outer circumferential surface of the wire.

12. The connector assembly of claim 11, wherein the uneven portions include a plurality of bands along the inner circumferential surface of the wire grooves, the plurality of bands are formed along a longitudinal direction of the wire.

13. The connector assembly of claim 9, wherein the first division member and the second division member each have a first locking portion, the first locking portion having a projection formed on a coupling surface of one of the first division member and the second division member and a groove formed on the other one of the first division member and the second division members, the projection inserted into the groove.

14. The connector assembly of claim 9, wherein the first division member and the second division member each have a second locking portion, the second locking portion having a protrusion protruding outward from one of the first division member and the second division member and a protruding piece on the other one of the first division member and the second division member, the protrusion locking with the protruding piece.

15. The connector assembly of claim 9, wherein the position assurance member has a latch formed at a first end portion to be inserted into the plug or the cap housing, the latch is formed on one of the first division member and the second division member.

16. The connector assembly of claim 9, wherein the first division member and the second division member each have an edge with a sealing stepped portion, the sealing stepped portion has a first sealing stepped portion formed along the edge of one of the first division member and the second division member and a second sealing stepped portion formed along the edge of the other one of the first division member and the second division member, the second sealing stepped portion covering the first sealing stepped portion.

17. The connector assembly of claim 9, further comprising a connector connecting the first division member and the second division member.

18. The connector assembly of claim 1, wherein the plurality of first stepped portions of the plug-side flange include a first plurality of surfaces opposing corresponding surfaces of the plurality of second stepped portions of the cap housing in an insertion direction of the cap housing into the plug-side flange.

19. The connector assembly of claim 18, wherein the plurality of first stepped portions of the plug-side flange further comprise a second plurality of surfaces opposing corresponding surfaces of the plurality of second stepped portions of the cap housing in a direction transverse to the insertion direction.

20. The connector assembly of claim 19, wherein a first one of the first plurality of surfaces is offset from a second one of the first plurality of surfaces in the direction of insertion, and a first one of the second plurality of surfaces of the plug-side flange is arranged between the first and second one of the first plurality of surfaces.

* * * * *